US006286161B1

(12) United States Patent
McCall

(10) Patent No.: US 6,286,161 B1
(45) Date of Patent: Sep. 11, 2001

(54) CORNER CONNECTORS AND METHODS

(75) Inventor: Jason Lance McCall, Archdale, NC (US)

(73) Assignee: McCall & Brooks, LLC, Archdale, NC (US)

( * ) Notice: Subject to any disclaimer, the term of this patent is extended or adjusted under 35 U.S.C. 154(b) by 0 days.

(21) Appl. No.: 09/537,623

(22) Filed: Mar. 29, 2000

(51) Int. Cl.[7] ..... A47C 23/06; A47C 19/00
(52) U.S. Cl. ..... 5/400; 5/282.1; 403/231
(58) Field of Search ..... 5/400, 200.1, 282.1; 403/231, 401, 402

(56) References Cited

U.S. PATENT DOCUMENTS 4,535,494 * 8/1985 Diamondstein ..... 5/400
4,734,946 * 4/1988 Saputo ..... 5/282.1
5,701,653 * 12/1997 Rupe ..... 5/400

OTHER PUBLICATIONS

Mattress support (undated), 1 page.
Box spring base (undated), 1 page.

* cited by examiner

*Primary Examiner*—Alexander Grosz

(57) ABSTRACT

Preformed corner connectors for mattress supports and box spring bases are provided to simplify and reduce the costs of constructing the same. The corner connectors are preferably unitarily formed by plastic molding or other suitable processes. The method of using the corner connectors includes preforming the same and attaching frame members with conventional fasteners for box spring bases and mattress supports as required.

10 Claims, 7 Drawing Sheets

CORNER CONNECTORS AND METHODS

FIELD OF THE INVENTION

The invention herein pertains to mattress and box spring supports as are used in conventional beds. Particularly, the invention concerns the use of preformed corner connectors in mattress supports and box spring bases.

DESCRIPTION OF THE PRIOR ART AND OBJECTIVES OF THE INVENTION

Manufacturers of furniture components such as mattress supports and box spring bases in recent years have fallen under great competitive pressure in recent years due to foreign imports, low local unemployment and increased local competition. As a result, many manufacturers have eliminated conventional box springs that are normally used for mattress supports in beds and are instead supplying "built-up" mattress supports formed from wood. These built-up mattress supports are formed in rectangular fashion and are then sawed at each corner to fairly duplicate the rounded corners of conventional mattresses. Pine and other lightweight woods are used with square corner posts in the initial construction of the mattress supports after which the corners are band-sawed, often with difficulty and sometimes with sufficient inaccuracy to require additional fabrication or repair.

In addition to built-up mattress supports as aforedescribed, metal box spring manufacturers are utilizing relatively thin wooden bases to reduce weight and costs of box springs. Such bases again are formed from built-up wooden components which are first assembled in rectangular form with 90° corners which are subsequently rounded with a band saw or the like. Rounding of the corners is time consuming and requires a skilled worker, increasing the cost of labor and production.

Thus with the aforesaid problems and disadvantages of previous manufacturing and construction methods, the present invention was conceived and one of its objectives is to provide a preformed corner connector and method for use in mattress support and box spring base assembly methods which is easy to incorporate into conventional manufacturing techniques.

It is still another objective of the present invention to provide a corner connector which allows a relatively unskilled laborer to accurately assemble a mattress support with little training or skill.

It is yet another objective of the present invention to provide a corner connector for a mattress support which is inexpensive to manufacture yet provides an aesthetically pleasing, uniform result.

It is a further objective of the invention to provide a preformed corner connector which can be used for a box spring base.

It is still another objective of the invention to provide a corner connector which can be preformed in mass quantities such as through plastic molding to exact size requirements.

It is yet another objective of the present invention to provide a box spring base which is relatively light in weight and inexpensive to manufacture.

Various other objectives and advantages of the present invention will become apparent to those skilled in the art as a more detailed description is set forth below.

SUMMARY OF THE INVENTION

The invention herein pertains to corner connectors such as manufactured from plastic, wood or other suitable components. The corner connectors are preformed, i.e. completed before initial assembly of a mattress support or box spring base, as required. In one embodiment a corner connector for a mattress support includes a series of planar members of different sizes which are joined to a main central block and assembled with a coincidental arcuate rear surface or corner.

In another embodiment, a preformed corner connector for a box spring base is provided. The corner connectors are formed such as by injection molding of a suitable plastic as is conventional in the trade.

DETAILED DESCRIPTION OF THE PREFERRED EMBODIMENTS AND OPERATION OF THE INVENTION

Figure 1:
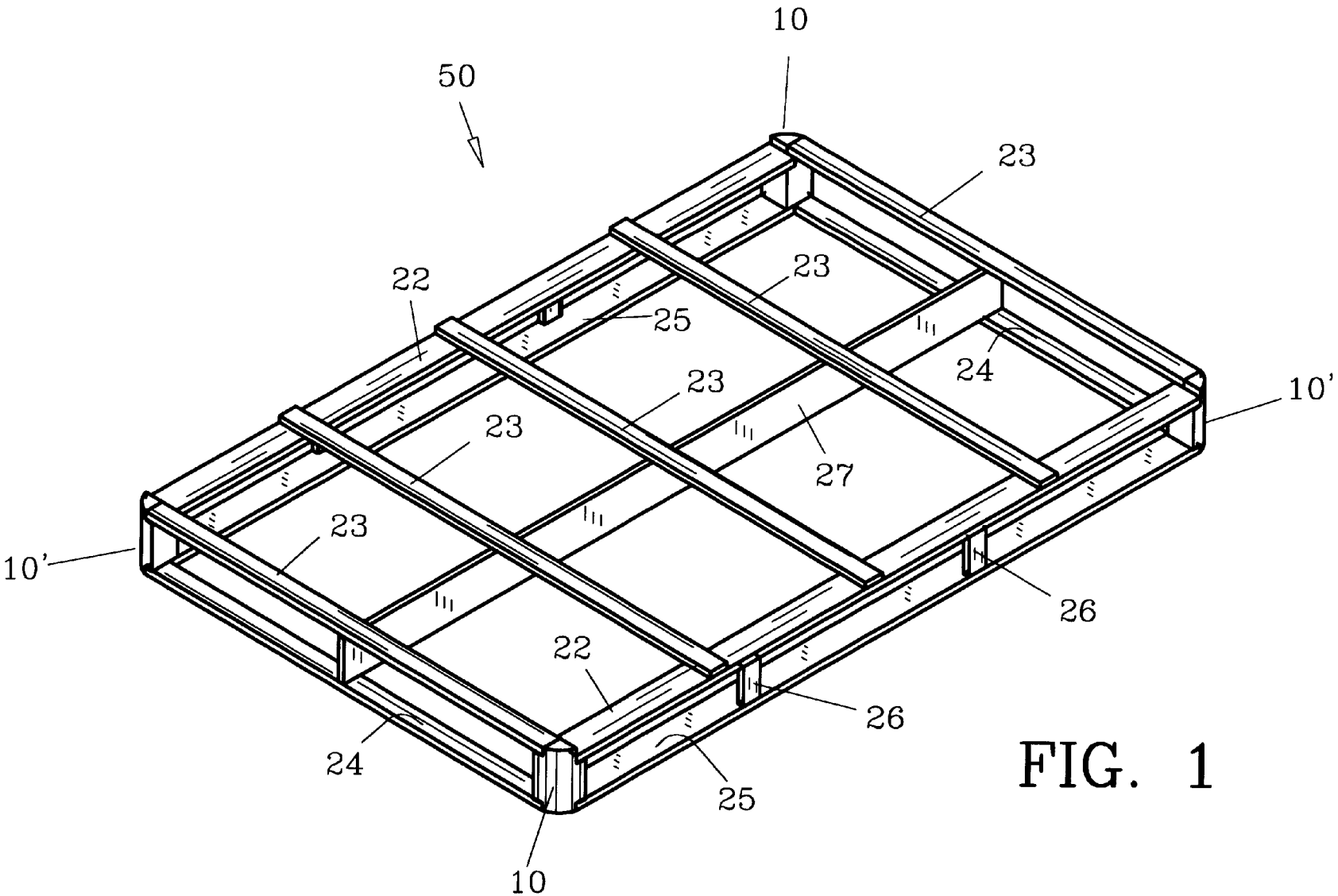
FIG. 1 demonstrates a perspective view of a mattress support of the invention.
Figure 5:
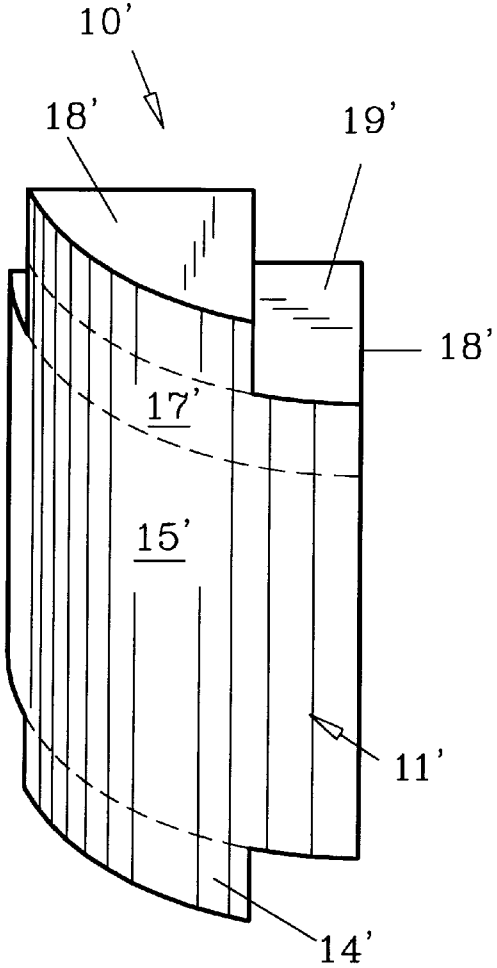
FIG. 5 pictures a corner connector which is a mirror image of the corner connector as shown in FIG. 2.
Figure 2:
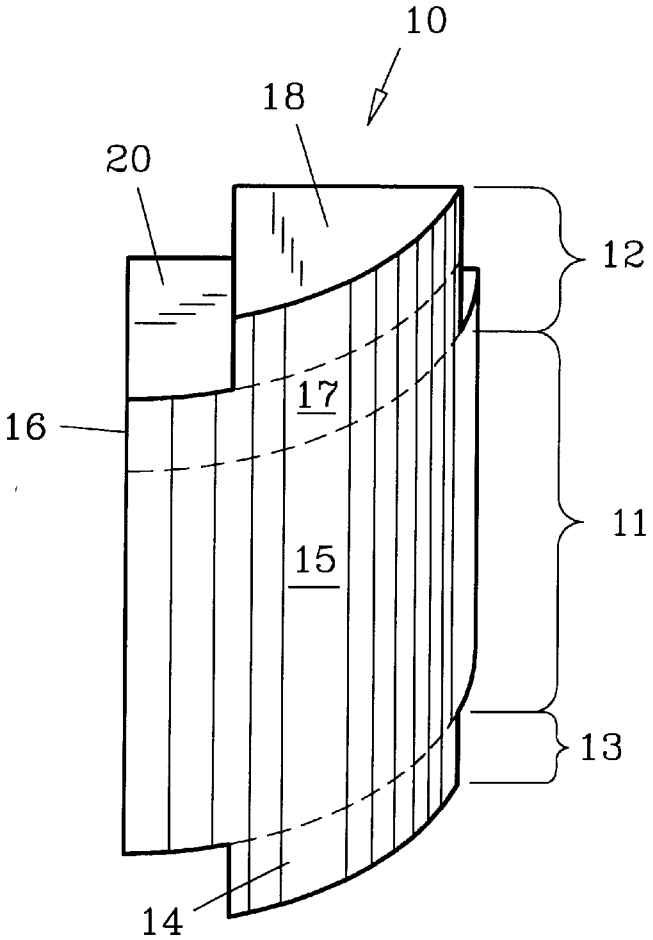
FIG. 2 shows a corner connector as used in the mattress support of FIG. 1.
Figure 6:
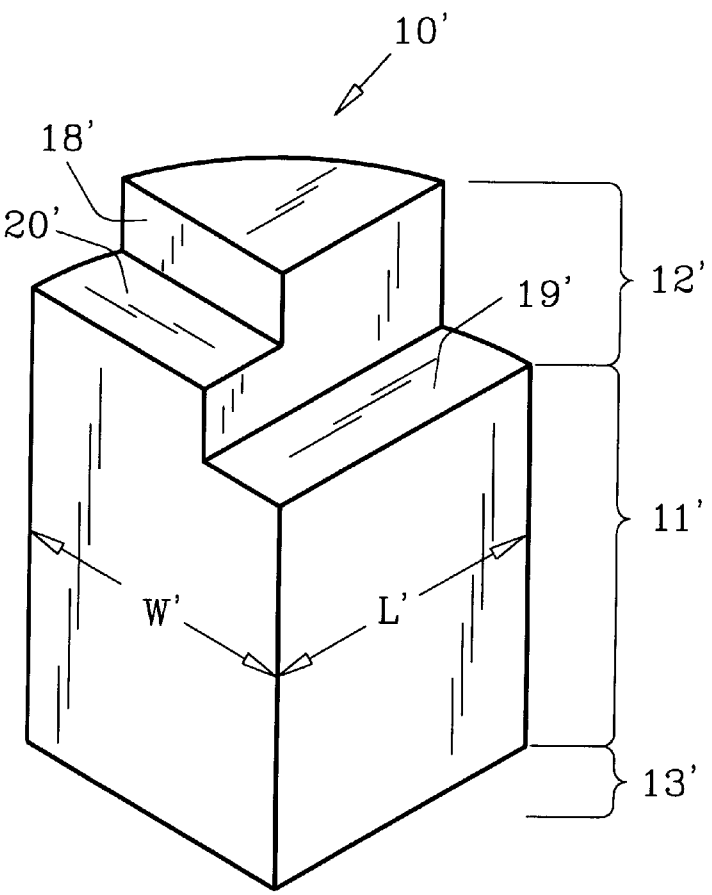
FIG. 6 shows another view of the corner connector as seen in FIG. 5.
Figure 3:
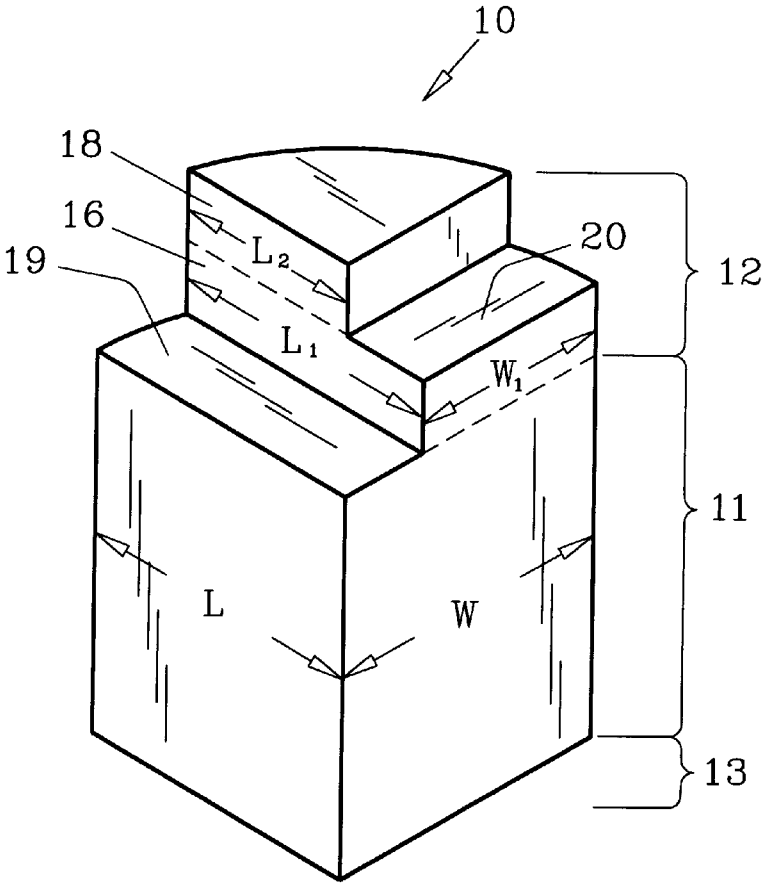
FIG. 3 depicts another view of the corner connector as shown in FIG. 2.

For a better understanding of the invention and its operation, turning now to the drawings, as shown in FIG. 1, preferred corner connectors 10, 10' can be used to form preferred mattress support 50 in place of conventional metal box springs to support mattresses for beds. Corner connectors 10, 10' are mirror images of each other as seen in FIGS. 2–7 showing different views thereof for clarity. Corner connector 10 is preferably unitarily formed from plastic by molding, though wood or other suitable materials can be used and sections made independently and connected, such as by adhesives, staples, screws or other fasteners. As shown in FIGS. 2 and 3, corner connector 10 includes a main central body or block section 11, a top section 12 and a lower section 13. Top section 12 includes a first planar member 16 (FIG. 3) which defines an arcuate rear surface or corner 17 (FIG. 2), which is coincidental with arcuate rear block surface or corner 15. Planar member 16 is positioned atop block section 11 and arcuate rear corner 17 is coincidentally aligned with rear block corner 15, seen in FIG. 2. Planar member 16 has a width $W_1$ less than block width W, as seen in FIG. 3 to thereby form lower shelf 19 for attachment of frame member 22 shown in FIG. 1 when manufacturing mattress support 50. FIG. 6 provides a corner connector 10' which is a mirror image of corner connector 10 seen in FIG. 3.

Atop planar member 16 wedge-shaped planar member 18 is positioned as seen in FIGS. 2 and 3 which has a length $L_2$ somewhat less than length $L_1$ of planar member 16, to thereby form shelf 20. Thus, planar members 16 and 18 are preferably of the same thickness and have equal widths, but different lengths. Shelf 20 is perpendicular to shelf 19 as will be explained in detail below for attachment to frame member 23 as seen in FIG. 1.

Figure 7:
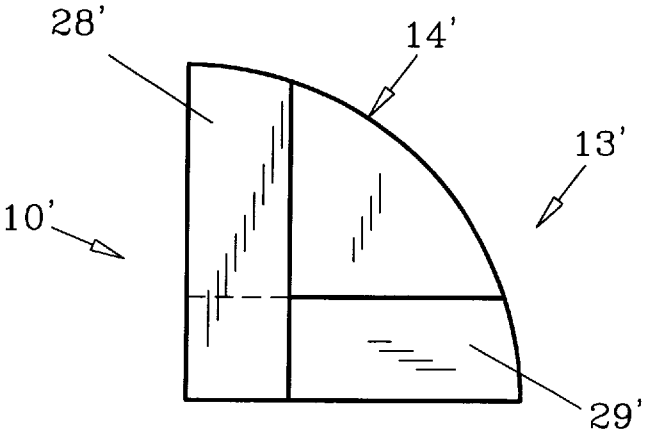
FIG. 7 illustrates a bottom view of the corner connector of FIG. 5.
Figure 4:
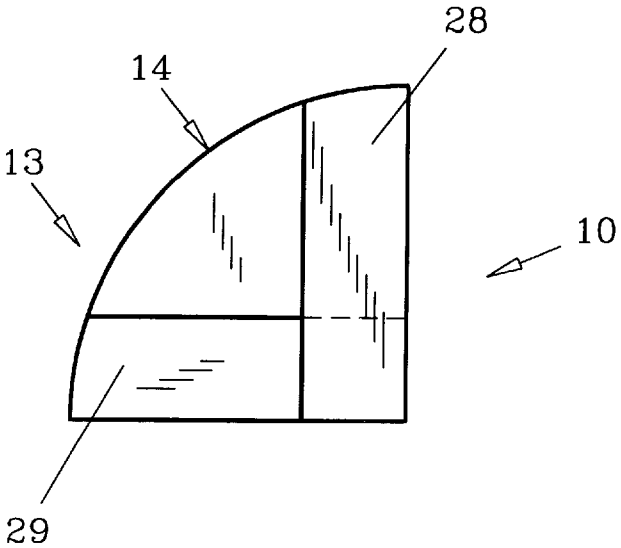
FIG. 4 features a bottom view of the corner connector as seen in FIG. 2.

Corner connectors 10, 10' each have respectively, lower sections 13, 13' as illustrated in the bottom views thereof shown in FIGS. 4 and 7. As seen, corner connector 10 includes a wedge-shaped planar member 14 whereas corner connector 10' includes a wedge-shaped planar member 14'. Planar members 14 and 14' like top members 18, 18' have a rear surface or corner which is coincidental with the block rear corners 15, 15' as shown in FIGS. 2 and 5. Planar wedge-shaped members 14 and 14' each form a pair of perpendicular shelves 28, 29, 28', 29' respectively as shown in FIGS. 4 and 7 for receiving and attaching upper lateral frame members 24 and upper longitudinal frame members 25 as seen in FIG. 1.

In mattress support 50 as shown in FIG. 1, four corner connectors (two each of 10 and 10') are utilized, which as earlier explained are mirror images. By using preformed corner connectors 10, 10' mattress support 50 can be easily assembled and irregularity of the corners of the finished mattress support is therefore eliminated. The preferred method of forming mattress support 50 includes the steps of forming a pair of corner connectors 10 and a pair of corner connectors 10' by conventional plastic molding techniques and placing them as shown in FIG. 1. in a jig or otherwise. Next, upper frame members 22, 23 are attached such as by nailing, stapling or the like along with lower lateral frame members 24 and lower longitudinal frame members 25. Vertical braces 26 are added and likewise fastened. Vertical frame member 27 is also joined as is usual in construction of mattress supports. Once completed, a lightweight but strong mattress support is available for placement in a bed frame (not shown) for receiving a mattress in place of a standard, heavy metal box spring.

Figure 11:
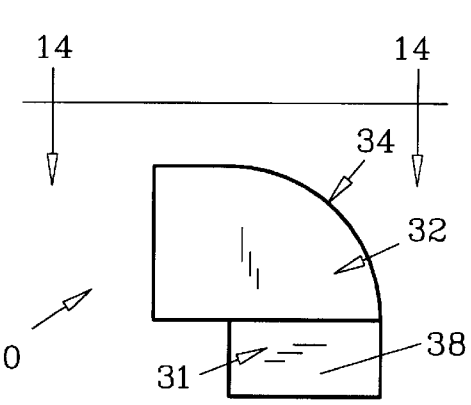
FIG. 11 demonstrates the corner connector of FIG. 8 in an inverted position.
Figure 8:
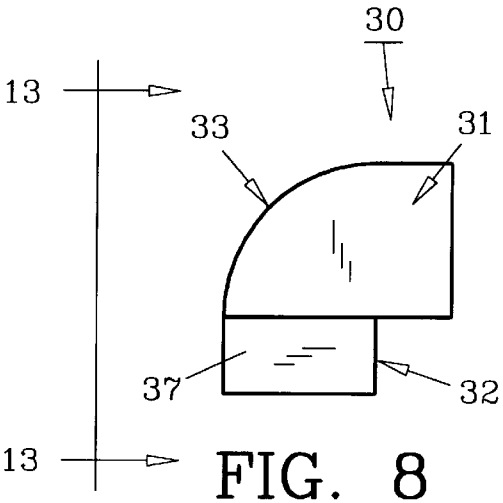
FIG. 8 depicts a top view of a corner connector as used in a box spring base.
Figure 10:
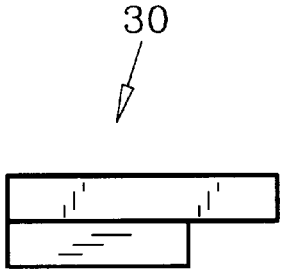
FIG. 10 shows a view of the corner connector as seen in FIG. 9 along lines 10—10.
Figure 14:
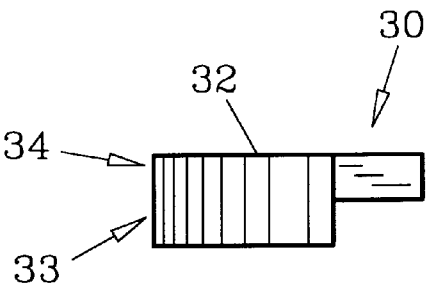
FIG. 14 illustrates the corner connector as seen in FIG. 11 along lines 14—14.
Figure 13:
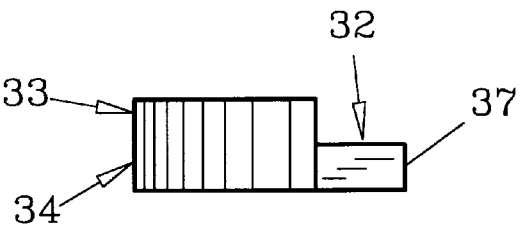
FIG. 13 shows a view of the corner connector of FIG. 8 along lines 13—13.
Figure 15:
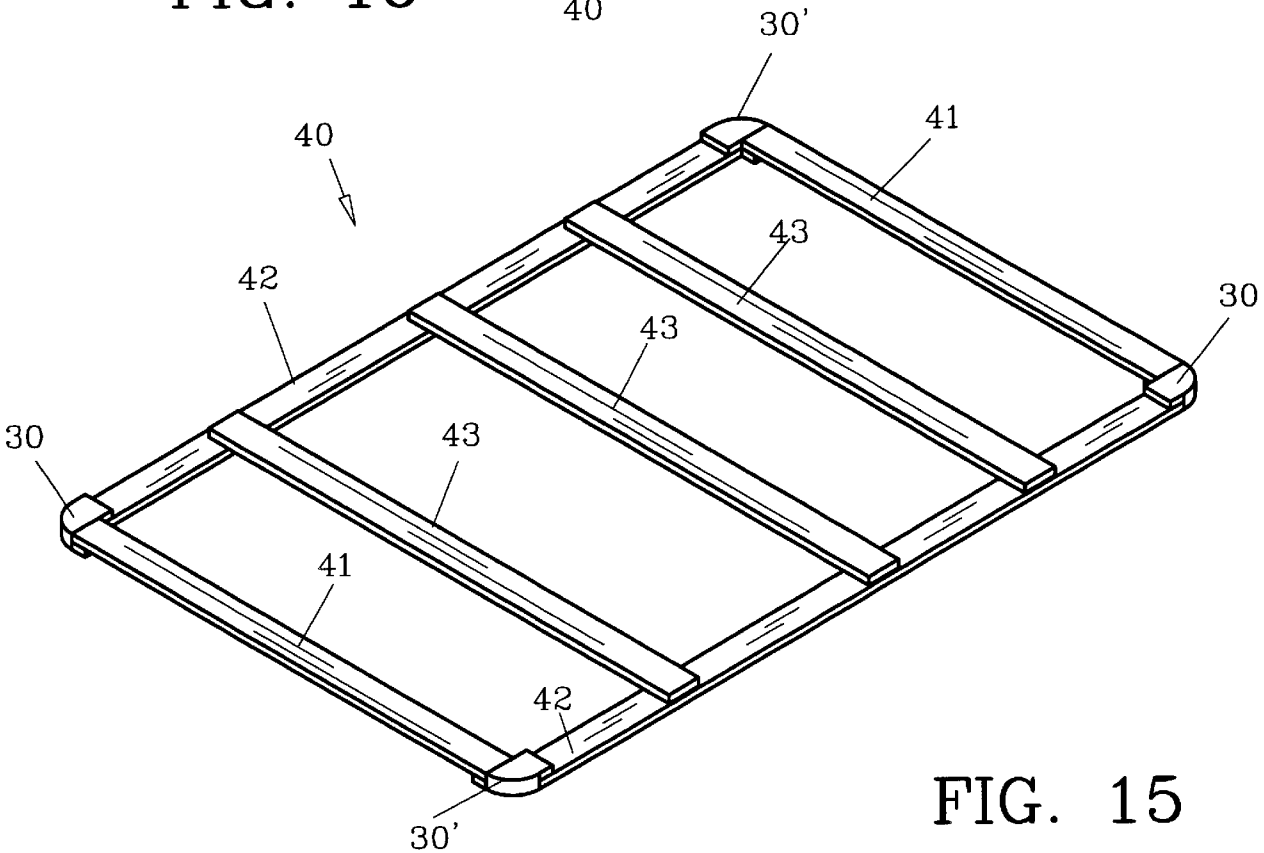
FIG. 15 provides a view of a box spring base utilizing the corner connectors as seen in FIGS. 8–14.

FIG. 8 illustrates preferred corner connectors 30, 30' (30' not seen) as used in preferred box spring base 40 for conventional metal box spring 45 (FIG. 16) as used for a bed. Corner connector 30 includes an upper planar member 31 and a lower planar member 32, as also seen in FIG. 11 in an inverted posture. Upper member 31 includes arcuate corner 33 coincidentally aligned with arcuate corner 34 of lower member 32, arcuate corner 34, as seen in FIGS. 11, 13 and 14. Corners 33 and 34 are coincidentally positioned to form outer rounded corners of box spring base 40 as seen in FIG. 15. Upper member 31 and lower member 32 may be made independently of wood, plastic or other suitable materials and are joined such as by adhesives, screws, nails, staples or other fasteners, but preferably are unitarily formed of suitable plastic by conventional molding techniques. Corner connector 30' (not explained in detail) is a mirror image of corner connector 30 as seen in FIG. 15.

Figure 9:
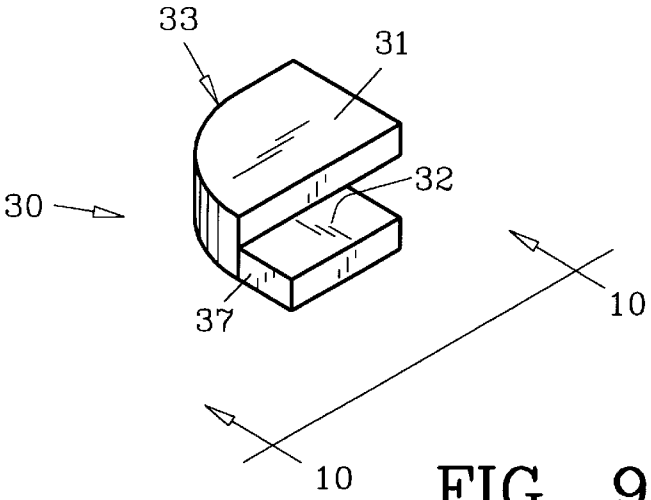
FIG. 9 features another view of the corner connector as shown in FIG. 8.
Figure 12:
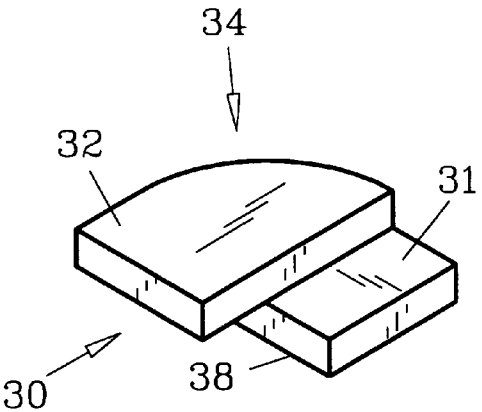
FIG. 12 provides another view of the corner connector as seen in FIG. 11.

As further seen in FIGS. 8, 9 and 13, lower member 32 includes a portion 37 which extends beyond upper member 31. Also, as in FIGS. 11 and 12, member 31 includes a portion 38 which extends beyond upper member 32. Portions 37, 38 are used to support base frame members such as frame members 41, 42 in FIG. 15. Frame members 41, 42 are affixed to corner connectors 30 such as by nails, staples, screws or otherwise as desired. As would be understood corner connectors 30, 30' which are mirror images are used in manufacturing box spring base 40. Corner connectors 10, 10' are used to manufacture mattress support 50 as seen in FIG. 1.

Figure 16:
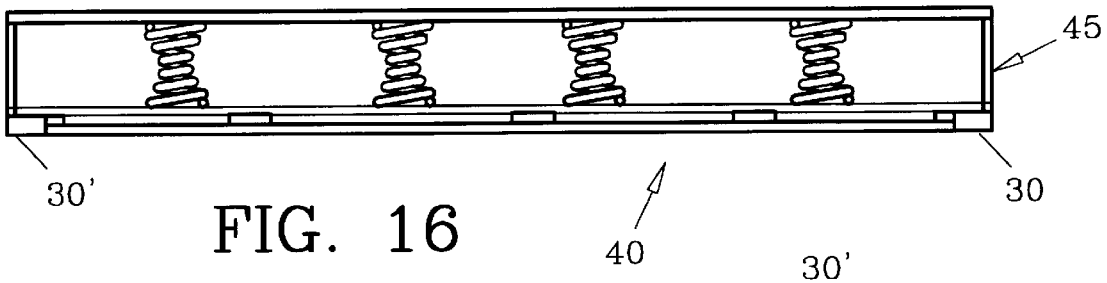
FIG. 16 shows a conventional box spring mounted on the box spring base as seen in FIG. 15.

Once manufactured, corner connectors 30, 30' allow for fast, efficient construction of box spring base 40 used with standard metal box springs 45 as seen in FIG. 16 affixed to box spring base 40 such as by staples, screws or other conventional fasteners.

The preferred method of use of corner connectors 30, 30' consists of first forming the same from suitable polymeric materials such as by conventional plastic molding techniques. A box spring base, such as box spring base 40 as built with standard wooden frame members 41, 42 as seen in FIG. 15 including wooden lateral members 43 for additional support. As earlier discussed, lateral frame members 41, 43 and longitudinal frame members 42 are joined to each other and to corner connectors 30, 30' such as by nails, staples, screws or other conventional fasteners. By employing preformed corners 30, 30' as shown in FIGS. 15 and 16 time and effort is saved as the preformed corners do not have to be sawed or trimmed after assembly of box spring base 40 as is conventional. The corners are more uniform and are aesthetically pleasing.

The illustrations and examples provided herein are for explanatory purposes and are not intended to limit the scope of the appended claims.

I claim:

1. A corner connector for a mattress support comprising: a block, said block defining an arcuate corner, a top section, said top section comprising a first planar member, said first planar member defining an arcuate corner, said first planar member positioned on said block with said arcuate corner coincidentally aligned with said arcuate corner of said block, said first planar member having a width less than said block width, a second planar member, said second planar member defining an arcuate corner, said second planar member positioned on said first planar member with said first planar member and said second planar member arcuate corners coincidentally aligned, said second planar member having a width less than said block width, and a length less than said first planar member.

2. The corner connector of claim 1 unitarily formed.

3. The corner connector of claim 1 formed from wood.

4. The corner connector of claim 1 formed from plastic.

5. The corner connector of claim 1 further comprising a bottom section, said bottom section comprising a third planar member, said third planar member positioned on said block, said third planar member defining an arcuate corner, and said third planar member arcuate corner coincidentally positioned with said block arcuate corner, said third planar member having a width less than the width of said block width.

6. The corner connector of claim 5 unitarily formed.

7. The corner connector of claim 5 formed from wood.

8. The corner connector of claim 5 formed from plastic.

9. A mattress support comprising a corner connector as claimed in claim 5.

10. A mattress support comprising a corner connector as claimed in claim 1.

* * * * *